United States Patent [19]

Simoncelli

[11] Patent Number: 5,074,133

[45] Date of Patent: Dec. 24, 1991

[54] FASTENER FOR A SLIDING WINDOW

[75] Inventor: M. Philippe Simoncelli, Sarrebourg, France

[73] Assignee: Ferco International, Sarrebourg, France

[21] Appl. No.: 356,688

[22] Filed: May 25, 1989

[30] Foreign Application Priority Data

Jun. 2, 1988 [FR] France ..... 88 07518

[51] Int. Cl.[5] ..... E05B 65/08

[52] U.S. Cl. ..... 70/90; 70/97; 70/99; 70/120; 292/31; 292/42; 292/DIG. 51

[58] Field of Search ..... 70/97, 119, 120, 90, 70/96, 98, 99, 100; 292/DIG. 51, 29-31, 42, 337, 162, 159-161

[56] References Cited

U.S. PATENT DOCUMENTS

| | | | |
|---|---|---|---|
| 1,294,949 | 2/1919 | Roberts | 70/120 |
| 3,175,873 | 3/1965 | Blomquist et al. | 292/159 X |
| 3,390,557 | 7/1968 | Erickson et al. | 70/97 |
| 3,633,389 | 1/1972 | Horgan, Jr. | 70/120 |
| 3,845,976 | 11/1974 | Peterson | 292/158 |
| 3,910,612 | 10/1975 | Guiraud | 292/337 X |
| 4,486,040 | 12/1984 | Strangward | 292/160 |
| 4,643,005 | 2/1987 | Logas | 292/DIG. 46 X |
| 4,773,682 | 9/1988 | Saelzer | 292/161 X |
| 4,848,811 | 7/1989 | Laufenburg et al. | 292/DIG. 53 X |

FOREIGN PATENT DOCUMENTS

| | | | |
|---|---|---|---|
| 0220999 | 5/1987 | European Pat. Off. . | |
| 0345185 | 12/1989 | European Pat. Off. | 70/95 |
| 564933 | 11/1932 | Fed. Rep. of Germany | 292/161 |
| 196740 | 3/1958 | Fed. Rep. of Germany | 292/161 |
| 1187950 | 2/1965 | Fed. Rep. of Germany | 292/162 |
| 2508099 | 9/1976 | Fed. Rep. of Germany | 292/DIG. 51 |
| 2582710 | 12/1986 | France . | |
| 2582711 | 12/1986 | France . | |

*Primary Examiner*—Lloyd A. Gall

*Attorney, Agent, or Firm*—Sandler, Greenblum & Bernstein

[57] ABSTRACT

Fastener for sliding windows comprising a case fixed on the inner face of the front stile of the sliding leaf and serving as housing for a latch hook which can be controlled from both the outside and the inside. To obtain locking at several locations of the sliding window against the window frame, the fastener is equipped with at least one control rod sliding in a faceplate housed in a front stile of the leaf, with the control rod and latch hook being activated simultaneously.

10 Claims, 2 Drawing Sheets

FASTENER FOR A SLIDING WINDOW

BACKGROUND OF THE INVENTION

1. Field of the Invention

The invention concerns a fastening for a sliding window comprising a case fixed in application on the inner face of the front stile of the sliding leaf and serving as housing for a latch bolt controlled, from the outside, by a key element and, from the inside, by a slide activated by a gripping organ.

The invention will be more particularly used in the field of building fittings.

2. Description of the Prior Art

Fasteners conforming to the above description are already known. These fasteners comprise a case built up on the inner face of the front stile of the leaf and presenting a housing in which a latch hook is displaced. This is intended to cooperate with a keeper disposed on the stile of the window casing. The displacement of this latch hook is controlled, on the one hand, by a slide introduced in a recess machined in the outside wall of the case. On the other hand, the locking or unlocking of this latch hook can be controlled by a key element accessible from the outside of the leaf. For this purpose, said latch hook comprises, on its outward-looking face, an opening in the form of an isosceles triangle in which is displaced a control stud of a link cooperating with the key element.

Quite clearly, a fastening of this kind can assure the blocking of the leaf against its casing only at one central point, with the aid of the latch hook.

This means that it offers only a reduced degree of security and presents only relatively weak resistance in case of an attempt to break the door open.

SUMMARY OF THE INVENTION

With this in mind, the present invention proposes a design of fastening incorporating the above characteristics and, in addition, giving the possibility of multipoint locking, considerably improving its effectiveness against any criminal action.

For this purpose, the invention concerns a fastening for a sliding leaf, comprising a case fixed in application on the inner face of the front stile of said sliding leaf, and serving as housing for a latch hook controlled, from the outside, by a key element and, from the inside, by a slide activated by a gripping organ, this fastener being characterized by the fact that it comprises at least one control rod extending above and/or below the case and sliding in a faceplate housed in the front stile of the leaf, the latch hook and said operating rod being activated simultaneously, the latter comprising, in addition, means of cooperating with blocking organs in one piece with the stile of the window frame.

The advantages provided by this invention, apart from the locking at several levels of the sliding leaf against the window frame, consist in retaining a fitting in application of the case of the fastener, while offering the possibility of activating one or more control rods housed in the front stile of this leaf. This reduces the number of machinings required for placing this fastener, in comparison with a mechanism housed in the front edge of the front stile of the leaf.

Other aims and advantages of this invention will appear in the course of the description to follow which, however, is given only as an indication and is not limitative. This description will be more easily understood by the annexed drawings, in which:

DESCRIPTION OF THE PREFERRED EMBODIMENTS

Figure 1:
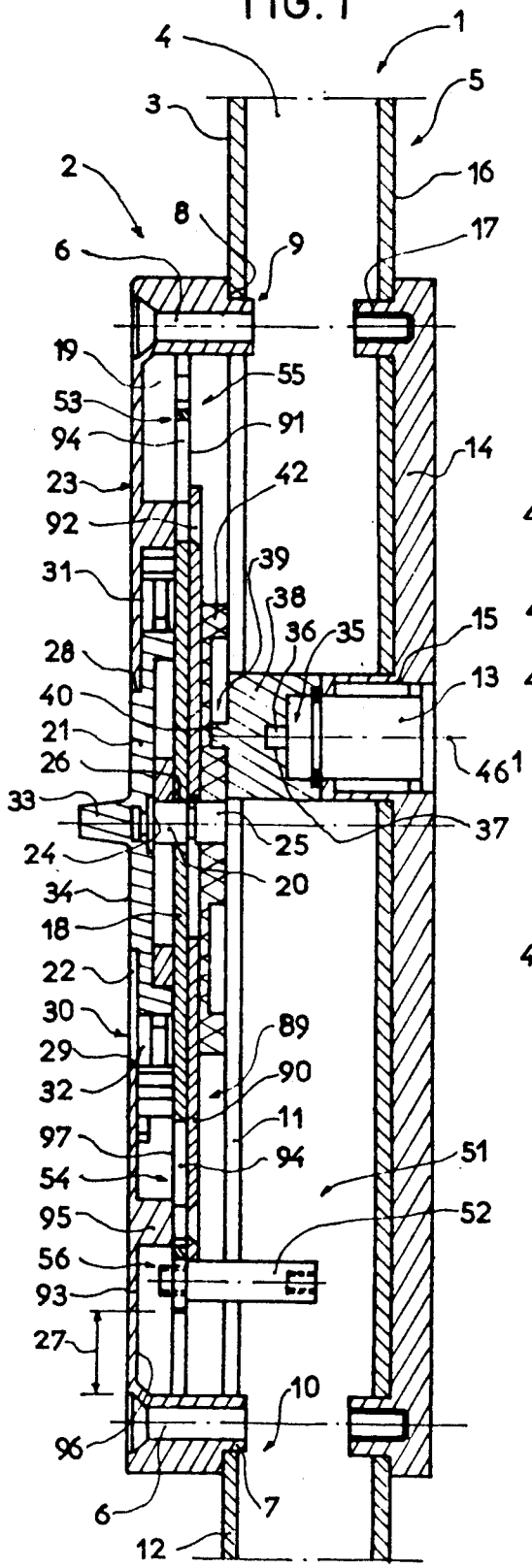
FIG. 1 is a view in elevation and in section of the fastener according to the invention.
Figure 2:
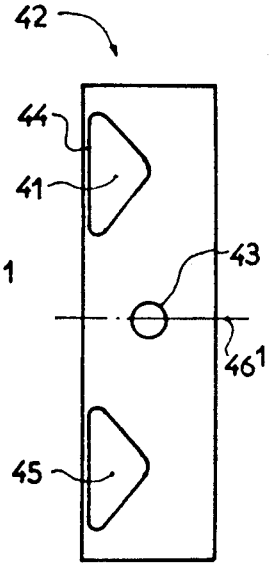
FIG. 2 is a view in elevation of the driving plate cooperating with the key element to control the latch hook of the fastener from the outside.

The fastener 1 according to the invention and represented in FIG. 1 is more particularly intended for fastening sliding windows.

This fastener 1 comprises a case 2 fixed in application on the inner face 3 of the front stile 4 of a sliding leaf 5 by means of fixing organs 6 such as screws, rivets or similar.

For this purpose, note the presence of salient edges 7 on the rear face 8 and close to the upper 9 and lower 10 edges of the case 2. These salient edges 7 fulfil the essential function of assuring the positioning of said case 2 in an opening 11 cut out in the inner wall 12 of the front stile 4 of the leaf 5.

For the purpose of control, from the outside, by means of a key element 13, of the fastener 1, this fastener comprises, in addition, an outside plate 14 provided with a housing 15 serving to receive said key element 13. This outside plate 14 is fixed, as its name implies, in application on the outside face 16 of the front stile 4. The salient sockets 17 presented on the inner face of this outside plate 14 assure its positioning to the right of the case 2 and, in particular, of the fixing organs 6 in such a way as to cooperate with the latter.

The mechanism of this fastener 1 is formed of a latch hook 18 inserted in a housing 19 machined in the rear face 8 of the case 2. This latch hook 18 is activated by a push rod 20 in one piece with a slide 21 moving in a recess 22 made in the outside face 23 of said case 2.

More precisely, the push rod 20 is formed by a spindle of which one of the extremities 24 is fixed to the slide 21, and of which the other free extremity 25 passes through an opening 26 made in the latch hook 18. The height of the recess 22 is more or less equal to the sum of the height of the slide 21 and the stroke 27 of the latch hook 18. Thus the upper edge 28 and lower edge 29 of this recess 22 constitute thrust plates cooperating with the slide 21 during locking and unlocking, and thereby limiting its displacement.

This configuration makes it possible to obtain a visualization hole 30 appearing, according to the case, above or below the slide 21 and informing the user, by the aid of signalling elements 31, 32 disposed in the vertical prolongation of said slide 21, of the position of the fastener 1.

Thus, on locking, the upper signalling element 31 is positioned in the visualization hole 30 above the slide 21 and comprises an indication serving to inform the user. In the contrary case, corresponding to unlocking, the signalling element 32 appears in the visualization hole 30 cleared under the slide 21.

This control of the latch hook 18 is facilitated by a gripping organ 33 which projects from the outside face 34 of the slide 21.

For the control of the latch hook 18 by the key element 13 fitting into a housing 15 machined in the outside plate 14, said key element comprises, at its extremity 35, a stud 36 fitting in an orifice 37 of a spacer 38. This is fitted, at its extremity 39, with a control pin 40 moving in an opening 41 in the shape of an isosceles triangle made in a driving plate 42. This cooperates with the latch hook 18. More precisely, this driving plate 42 is provided with an orifice 43 serving for the passage at the free extremity 25 of the spindle forming the push rod 20.

For the purpose of obtaining proper working of the fastener 1, it is indispensable for the base 44 of the opening 41 in the shape of an isosceles triangle to be situated in a vertical plane, parallel to the displacement of the latch hook 18. We may also note the presence of two openings 41, 45 disposed symmetrically in relation to the horizontal median plane $46_1$ of the latch hook 18 authorizing the reversibility of the fastener 1 for use of the right and the left of the sliding leaf 5.

Figure 3:
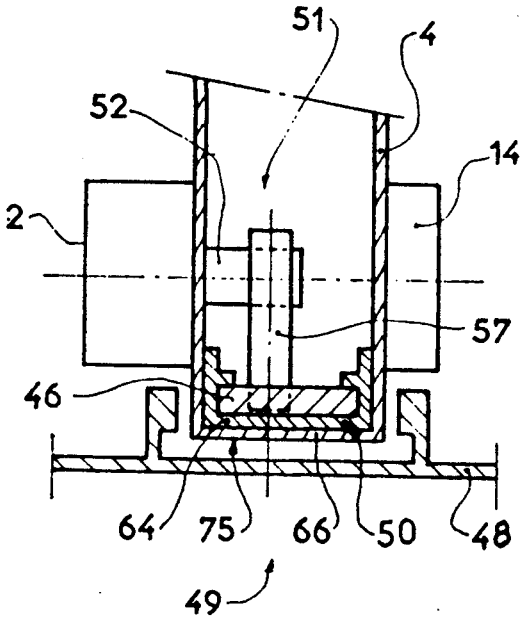
FIG. 3 is view in plane and in section of the front stile of a sliding leaf applied against the window casing and comprising a fastener conforming to the invention.
Figure 4:
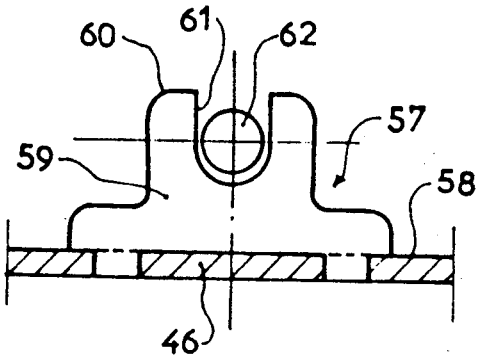
FIG. 4 is a view in elevation of the driving shoe fixed on one control rod and cooperating with a control pin in one piece with the latch hook.

Because the latch hook 18 constitutes only one point of central locking of the leaf 5, we provide the fastener 1, according to one characteristic of the invention, with at least one control rod 46. The latter extends above and/or below the case 2, and cooperates with one or more blocking organs disposed on the stile 48 of the window frame 49. In addition, it slides in a faceplate housing in the front stile 4 of the leaf 5. These constituent elements of the fastener 1 are more particularly visible in FIGS. 3, 6 and 7.

Advantageously, this operating rod (or rods) 46 and the latch hook 18 are activated simultaneously by means of the slide 21 or of the key element 13. For this purpose, and according to the invention, the fastener 1 comprises means 51 of linking the latch hook 18 to said operating rods 46.

Preferentially, these means 51 consist of control pins 52, locked with prolongations 53, 54 of the latch hook 18 at its extremities 55, 56. These control pins 52, disposed perpendicularly to the plane of the leaf 5, penetrate the front stile 4 of the latter through the opening 11, and cooperate with driving shoes 57 fixed on the rear face 58 of the control rods 46.

Naturally, if the fastening had only one operating rod 46, extending either above or below the case 2, it would suffice to equip the latch hook 18 with only one of these control pins 52. In these conditions, this is fixed, according to the case, to one or the other of the extremities 55, 56 of said latch hook 18.

Concerning the driving shoe 57, it is preferably formed of a flat 59, metallic, plastic or other, fixed, for example, by rivetting, in a vertical plane perpendicular to the plane of the control rod 46, on the rear face 58 of the latter. This flat 59 has, in its rear edge 60, a cut 61 adjusted to the spindle 62 forming the control pin 52. Thus, the cooperation of the latter with said driving shoe 57 is obtained by simple fastening when mounting the case 2 on the leaf 5.

The faceplate 50 in which the control rod(s) 46 slide, consists of one or more shaped sections 63, of a specific shape, applied on the inner face 64 of the front edge 66 corresponding to the front stile 4 of the leaf 5. This disposition avoids having to extend the faceplate 50 over the whole height of the control rods 46, while offering sufficient guidance and maintenance of the latter.

Thus these shaped sections 63 present a T-shaped groove, and consist of a front wall 67 and parallel lateral walls 68, 69, the latter being fitted with a return 70, 71 defining the above-mentioned "T" shape. Between the front wall 67 and the returns 70, 71, the control rod 46 slides.

Because the front wall 67 of the shaped sections 63 cooperates with the inner face 64 of the front edge 66 corresponding to the front stile 4, it comprises, at its extremities 72, 73 (as can be seen on FIG. 5) orifices 74 serving for the passage of the fixing organs. Advantageously, these orifices 74 are threaded, to cooperate with screws accessible from the outside face 75 of said front edge 66.

These extremities 72, 73 of the faceplate 50 can be planned, according to another mode of implementation, as dissociable, and can correspond to butts. These make it possible to adjust the height of the faceplate to that of the front stile 4 of the sliding leaf 5, or again to position orifices 74 to the right of the openings made in the front edge 66 and serving for the passage of the fixing screws. In this case, these butts, of section identical to the faceplate 50, comprise a tip lodging in the extremities of the shaped part 63 to position it and fix it in the inside of the front stile 4 of the sliding leaf 5.

Figure 5:
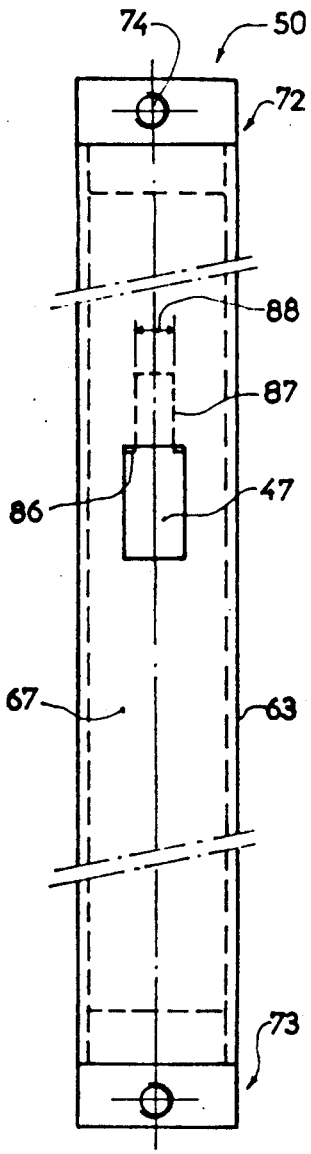
FIG. 5 is a view in elevation of the shaped part constituting the faceplate housed in the front stile of the leaf and serving as guide to the control rod.
Figure 6:
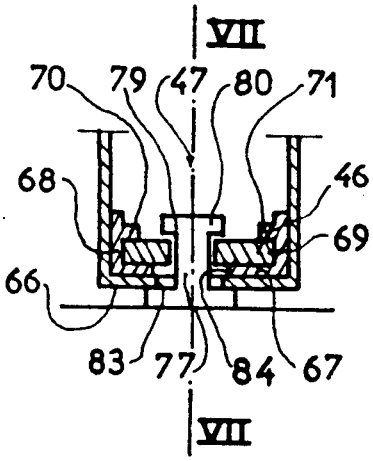
FIG. 6 is a partial view in plane and in section of the front stile of a sliding leaf equipped with a faceplate serving as guide to a control rod cooperating with blocking organs in one piece with the window frame.
Figure 7:
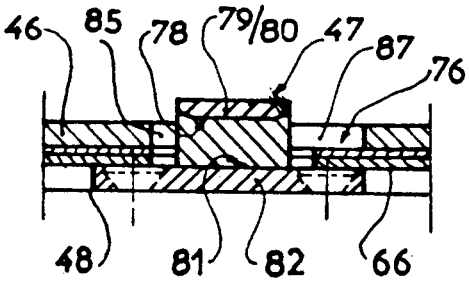
FIG. 7 is a view along section VII—VII of FIG. 6.

In the context of a particular mode of implementation represented in FIGS. 5 to 7, the control rod(s) 46 comprise means 76 for cooperating with the blocking organs 47 in one piece with the stile 48 of the window frame 49. This disposition avoids the presence of protruding organs on the front edge of the leaf 5 when the latter is opened. It is, however, possible to consider providing the rod(s) 46 with locking organs able to cooperate with keepers disposed on said window casing 49.

Thus, according to the mode of implementation corresponding to the different figures, the blocking organs 47 consist of shaped sections in the shape of a "T" composed of a branch 77 disposed parallel to the plane of the leaf 5 and fitted, at one extremity 78, with two lateral edges 79, 80. The other extremity 81 of this branch 77 is locked with a base 82 fixed on the stile 48 of the window frame 49.

In addition, the faceplate 50, just at the front edge 66 of the front stile 4 of the leaf 5, comprises, to the right of these blocking organs 47, an opening 83, 84 of sufficient size to permit the passage of the latter.

The control rods 46 are also fitted with openings 85, of dimensions determined in relation to those of the blocking organs 47. The openings 85 also have in their upper or lower edge 86 a cut 87 with a width 88 slightly more than the thickness of the branch 77 of the blocking organ 47.

This means that when the leaf is closed, said blocking organs 47 are able to fit into the openings 83, 84, 85 made respectively in the front edge 66 of the front stile 4, in the faceplate 50, and in the control rods 46. The action of the key element 13 of the slide 21 provokes the sliding of these control rods 46 and finally the engagement of the cuts 87 on the branch 77 of the blocking organs 47, at the rear of the lateral edges 79, 80. It is then impossible to obtain the withdrawal of said organs 47 from the front stile 4 of the leaf 5, without first having to unlock the fastener 1.

We may note that the control of the control rods 46 via the latch hook 18 causes constraints of torsion on the latter. This constraints could rapidly cause malfunction of the fastener 1 if the latch hook were neither maintained nor guided in the case 2.

It is for this purpose that the fastener 1 is provided with means 89 for suitable guiding and maintaining the latch hook 18 inside the housing 19 made in the case 2.

Preferentially, these means 89 consist substantially of a fixing plate 90 applied on the outer face 91 of the latch hook 18 and cooperating, by means of fixing elements 92, with the inner wall 93 of the case 2. This fixing plate 90 comes to be fixed between the driving plate 42 cooperating with the key element 13 and said latch hook 18.

Advantageously, this presents in its prolongations 53, 54 at the upper 55 and lower 56 extremities, oblong slits 94 serving for the passage of the fixing elements 92, and in this way contributing to guiding it.

In addition, the presence of lugs 95 in the bottom 96 of the housing 19 constitute bearing surfaces for guiding said latch bolt 18 on its inner face 97.

It may be noted that this fastener can be fitted, according to another mode of implementation, with a blocking device, as known in the previous state of the art, for blocking the displacement of the latch hook of one or other of the control rods as a consequence of direct action on one or other of the rods, for example by someone trying to break and enter. This association presents no difficulty of any kind to a skilled workman.

It cannot be denied that this fastener 1, in conformity with the invention, contributes a clear improvement to the level of security of sliding windows, first of all because of its multipoint locking, and secondly thanks to its reliability, mainly due to a less complex mechanism.

I claim:

1. Fastener for a sliding window within a stile of a window frame comprising a case positioned on the inner face of a front stile of a sliding leaf of the sliding window serving as a housing for a latch hook cooperating with the stile of the window frame, said latch hook being controllable from the outside by a key element, and from the inside by a slide activated by a gripping element, at least one control rod extending at a position which is at least one of above and below said case and sliding in at least one faceplate housed in the front stile of the sliding leaf, means for simultaneously activating said latch hook and said at least one control rod which comprise means for linking said latch hook to said at least one control rod, said means for linking including at least one control pin disposed perpendicularly to the plane of the sliding leaf for penetrating the front stile through an opening, and cooperating with at least one driving shoe fixed on a rear face of said at least one control rod, and said at least one control rod including means for cooperating with at least one blocking element attached to the stile of the window frame.

2. The fastener according to claim 1, wherein said at least one driving shoe comprises a flat portion attached to said rear face of said at least one control rod in a vertical plane perpendicular to said rear face, and said flat portion having at an upper edge a recessed portion for passage of said at least one control pin.

3. The fastener according to claim 2, wherein said driving shoe is constructed of metal or plastic.

4. The fastener according to claim 1, wherein said at least one faceplate includes at least one shaped section applied on an inner face of the front stile of the sliding leaf.

5. The fastener according to claim 4, wherein said at least one shaped section includes a T-shaped groove in which said at least one control rod is adapted to slide.

6. The fastener according to claim 5, wherein said T-shaped groove includes a front wall, and parallel lateral walls having end portions which face each other.

7. The fastener according to claim 4, wherein said at least one faceplate comprises extremities having orifices for the passage of fixing elements that are accessible from an outside face of the front stile.

8. The fastener according to claim 1, wherein said at least one faceplate includes a shaped section, and further including end portions which are dissociable from and of substantially the same section as said at least one faceplate, and said end portions having apertures so that said at least one faceplate can be immobilized on the front stile of the sliding leaf with fixing elements.

9. The fastener according to claim 1, further comprising means for guiding and maintaining said latch hook inside a housing in said case.

10. The fastener according to claim 9, wherein said latch hook has an outer face, and wherein said means for guiding and maintaining comprise a fixing plate mounted on the outer face of said latch hook and cooperating, by means of fixing elements passing through oblong openings in upper and lower extremities of said latch hook into an inner wall of said case.

* * * * *